United States Patent [19]

Her

[11] Patent Number: 5,009,222

[45] Date of Patent: Apr. 23, 1991

[54] DIVING CASE MASSAGER

[76] Inventor: Ming-Long Her, No. 24, Alley 3, Lane 42, Sec. 2, Hsiang Shang Road, Taichung City, Taiwan

[21] Appl. No.: 383,591

[22] Filed: Jul. 24, 1989

[51] Int. Cl.[5] ..... A61H 1/00

[52] U.S. Cl. ..... 128/36; 206/811; 220/4.22; 224/224

[58] Field of Search ..... 128/34, 35, 36; 206/811; 220/4 B, 4.22; 224/224

[56] References Cited

U.S. PATENT DOCUMENTS

| | | | |
|---|---|---|---|
| 1,575,524 | 3/1926 | Benjamin et al. | 206/811 X |
| 2,786,465 | 3/1957 | Moxley | 128/34 |
| 3,966,076 | 6/1976 | Kroger et al. | 220/4 B X |
| 3,996,929 | 12/1976 | Mabuchi | 128/36 X |
| 4,697,580 | 10/1987 | Terauchi | 128/35 X |
| 4,905,857 | 3/1990 | Her | 220/4 B |
| 4,935,972 | 6/1990 | Brady | 128/33 X |

*Primary Examiner*—Edgar S. Burr
*Assistant Examiner*—Moshe I. Cohen
*Attorney, Agent, or Firm*—Bacon & Thomas

[57] ABSTRACT

A diving case massager for convenient carriage with oneself by hanging on one's belt, which is including a water-tight casing having an inner chamber for setting therein of a vibrator, which produces vibrating effect to massage user's muscles, and for receiving therein of personal articles while the user is taking a swim or diving.

2 Claims, 5 Drawing Sheets

FIG

DIVING CASE MASSAGER

BACKGROUND OF THE INVENTION

The present invention is related to a diving case massager and more particularly to a diving case which is convenient to hang on user's belt for easy carriage with the user, and which is including a water-tight casing having an inner chamber for setting therein of a vibrator, which produces vibrating effect to massage user's muscles, and for receiving therein of personal articles while the user is taking a swim or diving.

Everybody knows that one shall have to change clothes when one goes swimming or diving. After having changed the clothes, one shall have to find a place or someone to entrust to receive one's clothes or precious articles. However, while swimming or diving, one may be unable to stop worrying about one's precious articles like watch, gold necklace, money or personal certificates or some other personal articles like drugs or something else. Some manufacturers are providing water-tight cases for binding up with oneself over the waist by means of an adjustable strip so as to allow for carriage of personal articles with oneself while swimming or diving.

Regularly, in order to prevent from spasm of muscles, one may take exercises to warm up the body before starting to swim or dive. However, spasm problem still tends to happen in abdomen region because of insufficient amount of warming-up.

Therefore, it is the main object of the present invention to provide a diving case massager which produce massaging effect onto user's abdomen region when the user is taking a swim or playing a diving game, so as to help the user get rid of spasm and have the muscles be relaxed.

Another object of the present invention is to provide a diving case massager which provides a water-tight chamber for receiving one's personal and precious articles while one is taking a swim or playing a diving game.

Another object of the present invention is to provide a diving case massager which includes an adjusting strip for easy binding of the diving case massager up with the user over any body portion.

Another object of the present invention is to provide a diving case massager which produces a vibrating force to stir up the water, when it is placed in a bath-tub, so as to generate ultrasonic water waves to massage the bather.

A yet further object of the present invention is to provide a diving case massager which includes a casing having received therein a detachable vibrator, wherein the vibrator may be removed from the casing to make more room for storage of personal articles in the casing.

Further objects, features and advantages of the present invention will become apparent from the following detailed description of the preferred embodiments considered in connection with the annexed drawings as hereunder.

BRIEF DESCRIPTION OF THE DRAWINGS

FIG. 1-A is a perspective assembly view of the present invention when it is in an opened condition;

DETAILED DESCRIPTION OF THE PREFERRED EMBODIMENTS

Figure 1:
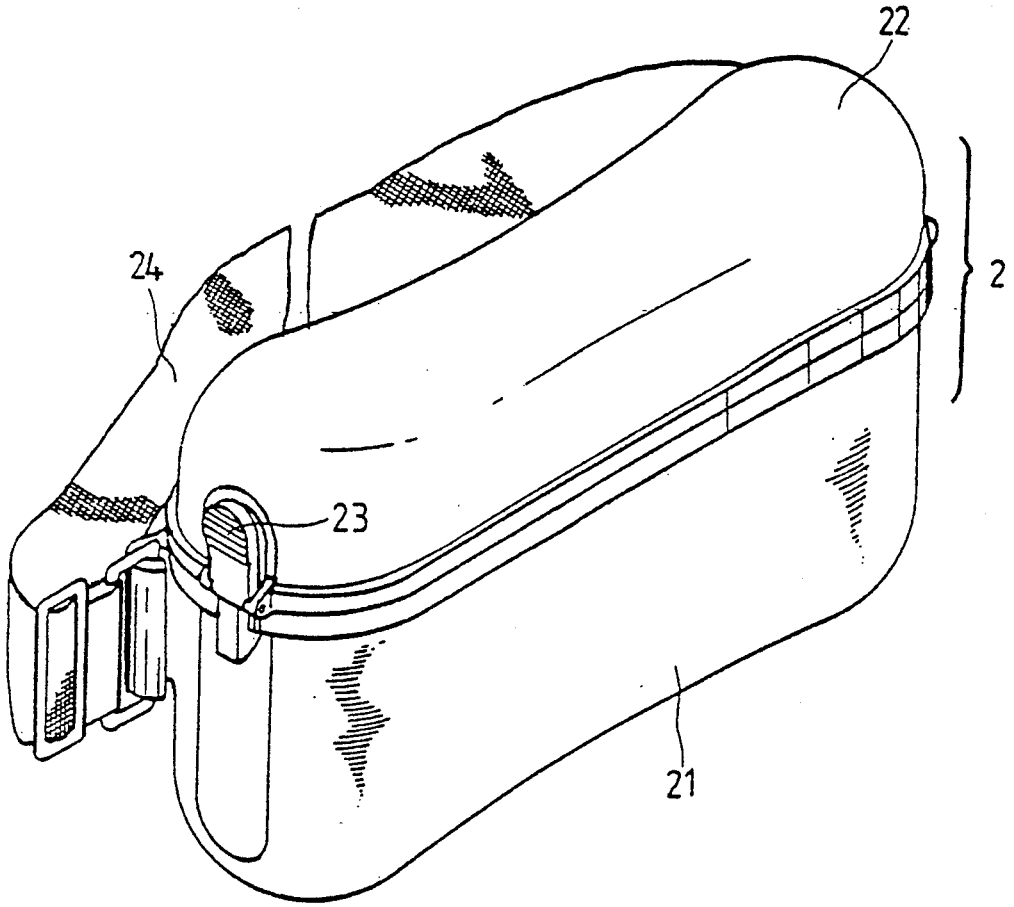
FIG. 1 is a perspective view of the present invention when it is in a closed condition.
Figure 1A:
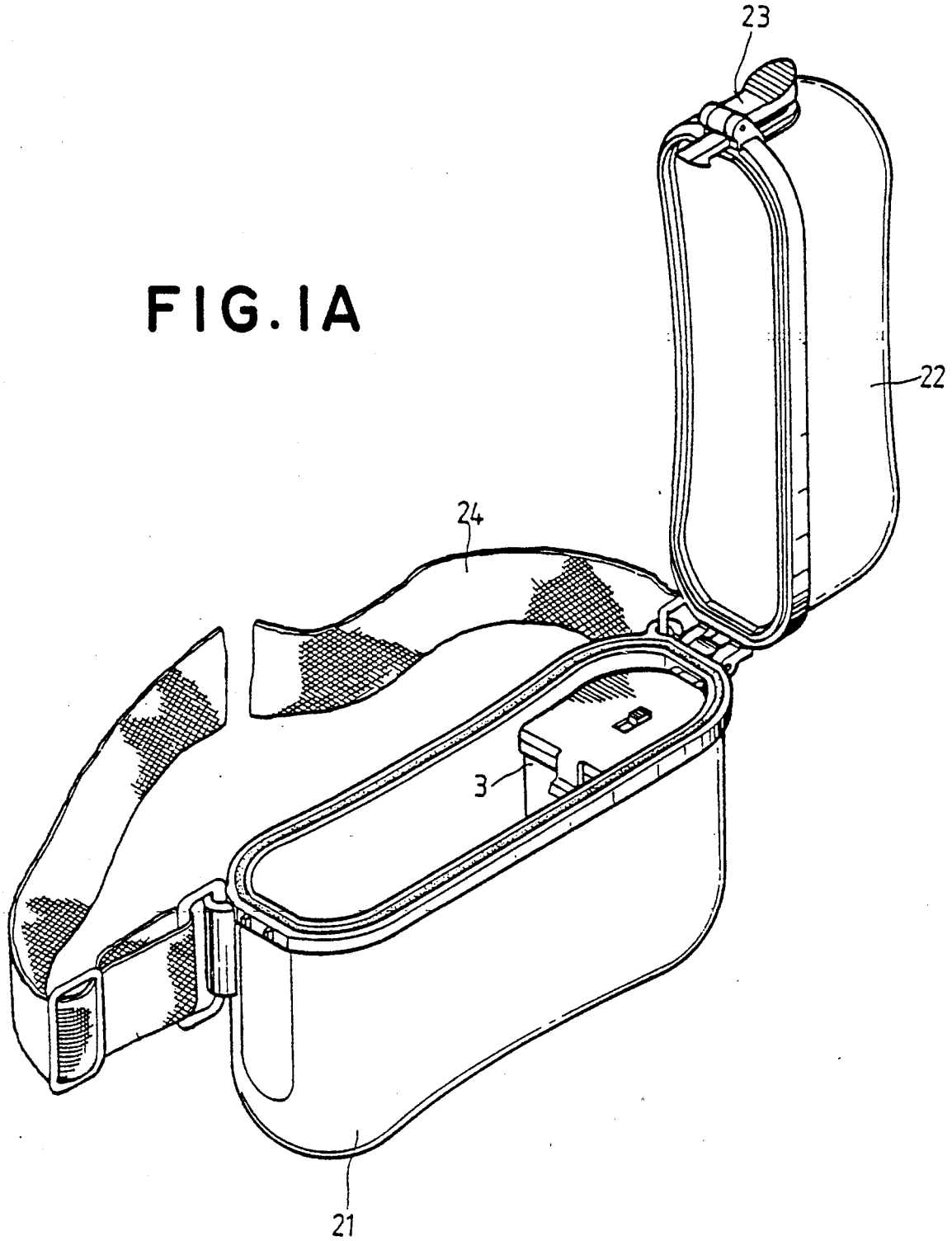
Figure 2:
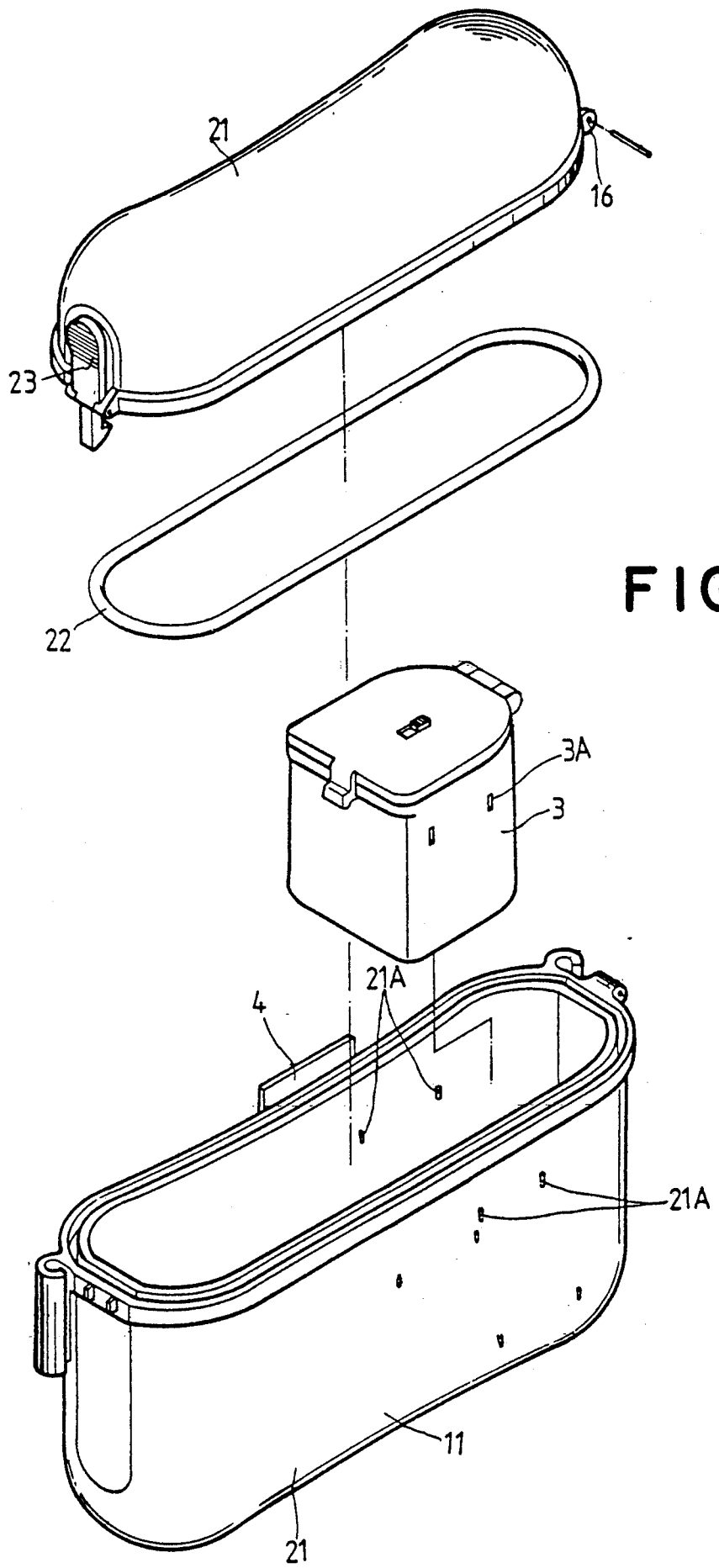
FIG. 2 is a perspective fragmentary view of the present invention.
Figure 3:
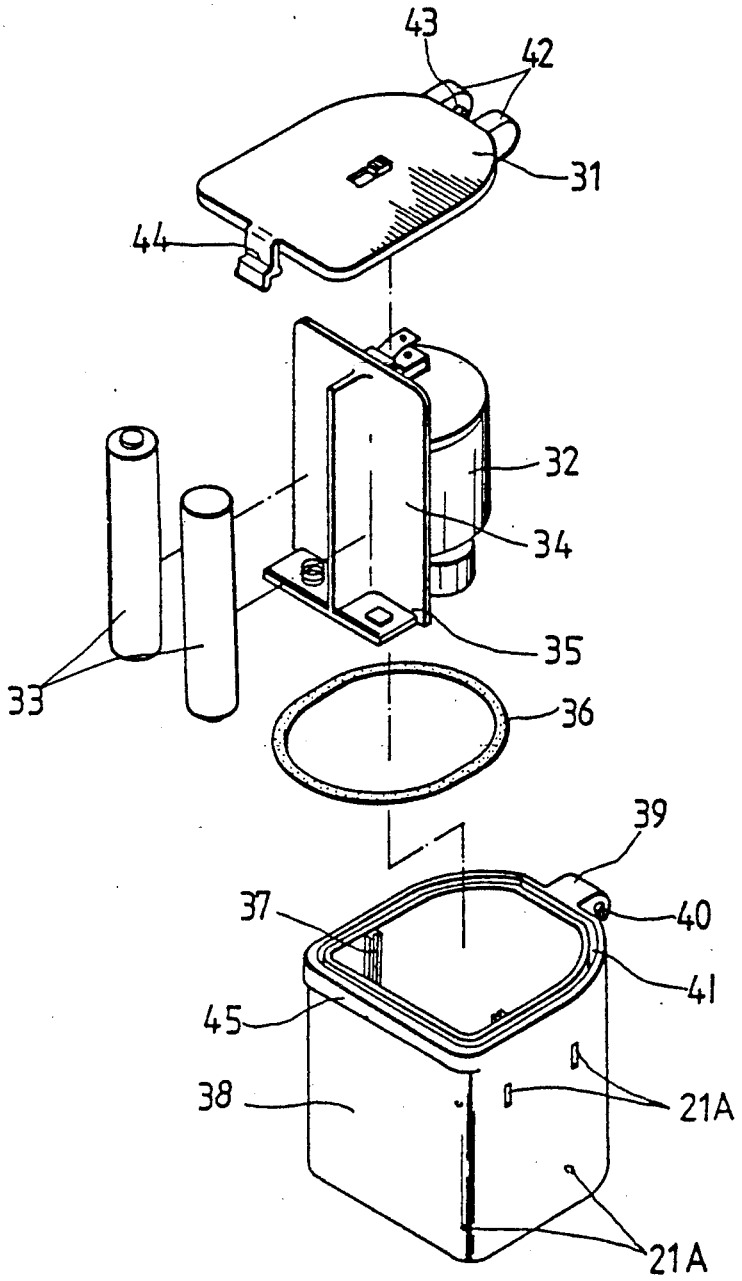
FIG. 3 is a perspective fragmentary view of the vibrator according to the present invention.

With reference to FIGS. 1 and 2, a diving case 2 is including a casing 21 having an upper cover 22 pivoted thereto. A fastener means 23 is mounted on the upper cover 22 to control water-tight connection of the upper cover 22 to the casing 21 when the upper cover 22 is covered over the casing 21. An adjustable strip 24 is adjustably connected to the casing 21 at both ends. With reference to FIG. 3, the casing 21 is comprising a plurality of tenons 21A respectively made on both inner side walls. A vibrator 3, which is comprising a plurality of grooves 3A respectively made on both outer side walls is received in the casing 21. When the vibrator 3 is set in the casing 21, the tenons 21A are respectively seated in the grooves 3A to let the vibrator 3 be firmly positioned thereto.

Please refer to FIG. 3 again. The vibrator 3 is mainly comprised of a housing 38, a cover plate 31, an eccentric motor 32, a holder plate 34 and a battery set 33. The eccentric motor 32 and the battery set 33 are mounted on the holder plate 34 at both sides respectively. The holder plate 34 is further set in the slide way 37 of the housing 38. The housing 38 is having an axle seat 39 made on the top edge, comprising an axial hole 40 for insertion therein from both ends of two stub tenons 43 of the two swing plates 42 of the cover plate 31 respectively so as to let the cover plate 31 be pivoted to the housing 38. The housing 38 also comprises a circular scoop channel 41 at the top around its periphery for setting therein of a resilient washer 36. When the cover plate 31 is connected to the housing 38 by means of inserting the stub tenons 43 into the axial hole 40 of the axle seat 39, the front snap means 44 of the cover plate 31 is engaged with the projecting portion 45 of the housing 38 beneath the scoop channel 41, such that, through the effect of the resilient washer 36, the whole structure of the vibrator 3 becomes water-tightly enclosed.

When the vibrator 3 is set in the casing 21 and is having its grooves 3A respectively engaged with the tenons 21A of the casing 21, both the vibrator 3 and the casing 21 become coupled into one unit. When the vibrator 3 is switched on, the eccentric vibrating force produced from the eccentric motor 32 will be transmitted through the casing 21 to apply on the body of the user so as to massage the muscles of the user where the device is attached and to help the user get relaxed. In addition to the space for receiving the vibrator 3, the inner space of the casing 21 is provided for receiving personal articles of the user for easy carriage with the oneself. Because the vibrator 3 is detachable, when no massage is required, it may be removed from the casing 21 to make more space for storage.

Figure 4:
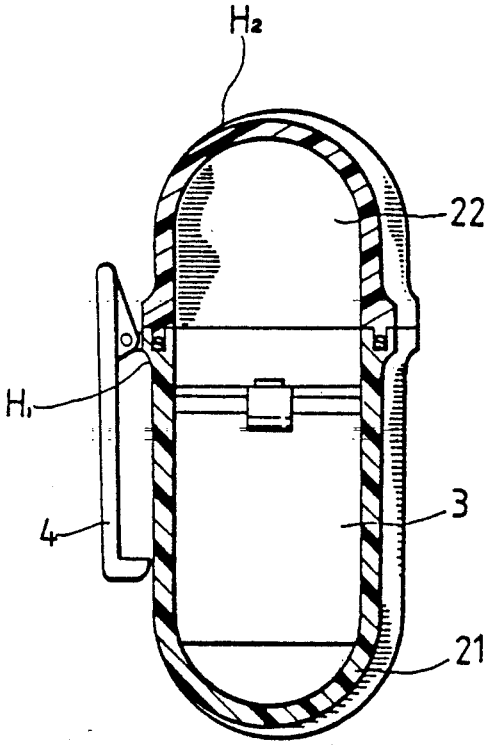
FIG. 4 is a sectional view of a second embodiment constructed according to the present invention.

In order to provide better massaging effect, the casing 21 and the upper cover 22 are arranged to have a smoothly curved side wall surface H1, that is, the both ends are respectively arranged in a spherical configuration, so as to be closely attached to user's body. Please refer to FIG. 4, as an alternate form, the adjustable strip 24 may be replaced by a hanger means 4 for hanging of the whole assembly on user's belt.

What is claimed is:

1. A diving case massager, including a vibrator having a housing with an outer wall surface and a slideway therein and a top edge and grooves bilaterally made in said outer wall surface thereof, a casing having an upper cover pivoted thereto to define an inner chamber for setting therein of said vibrator and comprising an adjustable strip with both ends adjustably connected to said casing for binding said casing to the user, wherein said casing comprises internally and bilaterally a plurality of tenons for respective insertion into said grooves so as to firmly retain said vibrator therein, and wherein said vibrator is comprised of said housing, a cover plate having two swing plates, each swing plate having a stub tenon, and front snap means, an eccentric motor, a holder plate, a battery set and a resilient washer, said eccentric motor and said battery set being mounted on said holder plate respectively at both sides thereof, said holder plate being further set in the slide way of said housing, said housing having an axle seat on said top edge and comprising an axial hole for insertion therein from both ends of said two stub tenons of the two swing plates of said cover plate, so as to let said cover plate be pivoted to said housing, said housing also comprising a circular scoop channel at the top around its periphery and a projecting portion beneath said scoop channel, said scoop channel having said resilient washer set therein to provide a water-tight seal when said cover plate is connected to said housing and said front snap means are engaged with said projecting portion of said housing.

2. The diving case massager as set forth in claim 1, wherein the casing is having a smoothly curved outer configuration for best fitting in with human body curve, and comprising a hanger means for hanging of the whole diving case assembly on user's belt.

* * * * *